US006415520B1

(12) United States Patent
Locklear

(10) Patent No.: US 6,415,520 B1
(45) Date of Patent: Jul. 9, 2002

(54) APPARATUS AND METHOD FOR FACILITATING ACCURATE PLACEMENT AND INSTALLATION OF CROWN MOLDING

(76) Inventor: Thomas Locklear, 21720 Wagram Rd., Laurinburg, NC (US) 28352

( * ) Notice: Subject to any disclaimer, the term of this patent is extended or adjusted under 35 U.S.C. 154(b) by 0 days.

(21) Appl. No.: 09/496,840

(22) Filed: Feb. 2, 2000

(51) Int. Cl.[7] ..... B43L 13/00; B43L 7/027

(52) U.S. Cl. ..... 33/481; 33/476

(58) Field of Search ..... 33/481, 404, 407, 33/429, 474, 476, 479, 485, 494, 526, 613, 644, 645, 679.1

(56) References Cited

U.S. PATENT DOCUMENTS

| | | | | | |
|---|---|---|---|---|---|
| 710,891 | A | * | 10/1902 | Pugh | 33/480 |
| 1,097,393 | A | * | 5/1914 | Criswell | 33/481 |
| 1,135,259 | A | * | 4/1915 | Cokely | 33/481 |
| 1,166,512 | A | * | 1/1916 | Dannenfelser | 33/480 |
| 1,523,919 | A | * | 1/1925 | Vitek et al. | 33/474 |
| 1,553,229 | A | * | 9/1925 | Fraser | 33/480 |
| 1,853,198 | A | * | 4/1932 | Breaden | 33/481 |
| 4,200,990 | A | * | 5/1980 | West | 33/476 |
| 4,420,891 | A | * | 12/1983 | Orem | 33/476 |
| 4,573,276 | A | * | 3/1986 | Torczon | 33/481 |
| 4,868,989 | A | | 9/1989 | Renaud | |
| 4,965,944 | A | * | 10/1990 | Kuze et al. | 33/481 |
| 5,050,306 | A | | 9/1991 | Renaud | |
| 5,123,172 | A | | 6/1992 | Thrun | |
| 5,361,510 | A | * | 11/1994 | Cox | 33/613 |
| 5,396,710 | A | * | 3/1995 | Battaglia | 33/481 |
| 5,727,325 | A | * | 3/1998 | Mussell | 33/481 |
| 5,737,844 | A | * | 4/1998 | Brumley | 33/194 |
| 5,802,730 | A | * | 9/1998 | Gomes | 33/481 |
| 5,855,073 | A | | 1/1999 | Boelling | |

* cited by examiner

*Primary Examiner*—Diego Gutierrez
(74) *Attorney, Agent, or Firm*—Adams, Schwartz & Evans, P.A.

(57) ABSTRACT

A tool for facilitating accurate placement and installation of crown molding at an intersection of a ceiling and wall, the crown molding having a wall-engaging portion and a ceiling-engaging portion. The tool includes first and second extension arms, each extension arm having respective inner and outer major surfaces and respective proximal and distal ends. The first and second extension arms are connected together at their respective proximal ends such that their respective inner major surfaces face each other at right angles for receiving and orienting a sample section of the crown molding. The sample section includes a first longitudinal side edge representing the wall-engaging portion of the crown molding for residing adjacent the first extension arm and a opposing second longitudinal side edge representing the ceiling-engaging portion of the crown molding for residing adjacent the second extension arm. Measurement indicia are marked on each of the inner major surfaces of the first and second extension arms for measuring the sample section and determining the position of the crown molding at intersection of the ceiling and wall.

6 Claims, 4 Drawing Sheets

APPARATUS AND METHOD FOR FACILITATING ACCURATE PLACEMENT AND INSTALLATION OF CROWN MOLDING

TECHNICAL FIELD AND BACKGROUND OF INVENTION

This invention relates to an apparatus and method for facilitating accurate placement and installation of crown molding.

Crown molding serves several important aesthetic and utilitarian functions, including the obscuring of the rough and abrupt intersection of a ceiling and wall, the general enhancement and refinement of the decor and design of a room, and the stabilization of some wall coverings where they intersect with a ceiling. However, because of the inherently elevated, overhead location of crown molding, installation can be cumbersome and difficult, sometimes requiring the cooperation of two or more workers. Prior art methods of installing crown molding require the location of the molding to be determined by holding a segment of the molding against an intersecting ceiling and wall. This method frequently results in inaccurate molding placement as evidenced by the misalignment of intersecting crown molding segments at the corners of a room. Misalignment of crown molding segments at the corner of a room is noticeable error that detracts from the aesthetically pleasing appearance of crown molding. Such misalignment results from inconsistent, imprecise, and incorrect measurement and placement of the individual crown molding segments. An example of an incorrectly placed crown molding segment is shown in FIG. 1. Looking briefly at FIG. 1, a crown molding segment "M" is installed at the intersection of a ceiling "C" and a wall "W". However, the crown molding segment "M" is placed incorrectly because the wall-engaging portion of the segment "M" is not in full and complete contact with the wall "W". This type of incorrect placement is typically the result of inaccurate, imprecise measurement of the crown molding segment and, as discussed such errors lead to visibly misaligned crown molding segments at the corners of rooms. Therefore, to prevent misalignment of the crown molding segments at the corner, precise and accurate measurement and placement of the crown molding segments is required. To solve these problems, the present invention provides a tool and method for facilitating precise and accurate crown molding measurement and placement.

More specifically, the present tool and method allow a single worker to measure the crown molding and determine its proper placement without having to hold a molding segment against an intersecting ceiling and wall, thereby increasing accuracy of crown molding installation while reducing the number of workers necessary to properly measure and locate crown molding segments. As is more fully described below, these results are achieved by using the method of the present invention to bed a representative crown molding segment in the simple apparatus of the present invention, which simulates the ceiling-to-wall intersection while providing measurement indicia for ensuring proper measurement and placement of the crown molding.

SUMMARY OF THE INVENTION

Therefore, it is an object of the invention to provide an apparatus and method for facilitating accurate placement and installation of crown molding.

It is another object of the invention to enable a single user to determine the proper measurement and placement of crown molding without holding a crown molding segment against an intersecting ceiling and wall.

It is another object of the invention to prevent misalignment of crown molding segments at the corners of rooms.

It is another object of the invention to simulate a ceiling-to-wall intersection while providing measurement indicia for measuring a crown molding segment.

It is another object of the invention to maximize the aesthetic and utilitarian advantages of crown molding by ensuring proper measurement and placement thereof.

These and other objects of the present invention are achieved in the preferred embodiments disclosed below by providing a tool for facilitating accurate placement and installation of crown molding at an intersection of a ceiling and wall, the crown molding having a wall-engaging portion and a ceiling-engaging portion. The tool includes first and second extension arms, each extension arm having respective inner and outer major surfaces and respective proximal and distal ends. The first and second extension arms are connected together at their respective proximal ends such that their respective inner major surfaces face each other at right angles for receiving and orienting a sample section of the crown molding. The sample section includes a first longitudinal side edge representing the wall-engaging portion of the crown molding for residing adjacent the first extension arm and a opposing second longitudinal side edge representing the ceiling-engaging portion of the crown molding for residing adjacent the second extension arm. Measurement indicia are marked on each of the inner major surfaces of the first and second extension arms for measuring the sample section and determining the position of the crown molding at intersection of the ceiling and wall.

According to one preferred embodiment of the invention, an edge scale is marked onto at least one elongate minor edge surface of at least one extension arm, the edge scale corresponding to and extending from the measurement indicia marked on the inner major surface of the at least one extension arm. According to another preferred embodiment of the invention, the smallest gradations of the measurement indicia and the edge scale each measure 1/16 of an inch.

According to yet another preferred embodiment of the invention, the extension arms are of substantially equal thickness.

According to yet another preferred embodiment of the invention, one of the measurement indicia is shifted relative to the other measurement indicia in an amount substantially equal to the thickness of one of the extension arms.

According to yet another preferred embodiment of the invention, the extension arms are formed of substantially rigid material.

According to yet another preferred embodiment of the invention, each of the extension arms is approximately 8 inches in length.

In another embodiment of the invention, a method is provided for facilitating accurate placement and installation of crown molding at an intersection of a ceiling and wall using a substantially L-shaped measurement tool. The crown molding includes a wall-engaging portion and a ceiling-engaging portion. First, a sample section of the crown molding is positioned on the tool. The sample section includes a first longitudinal side edge representing the wall-engaging portion of the crown molding and an opposing second longitudinal side edge representing the ceiling-engaging portion of the crown molding. The sample section is positioned on the tool such that the first side edge of the sample section resides adjacent an inner major surface of a first extension arm of the measurement tool and the second side edge of the sample section resides adjacent an inner major surface of a second extension arm of the measurement tool, the inner major surfaces of the first and second extension arms each being marked with measurement indicia for measuring the sample section and determining the position of the crown molding at the intersection of the ceiling and wall. With the sample section positioned adjacent the measuring tool, the distance from a proximal end of the first extension arm to the first side edge of the sample section is then measured. The sample section is then removed from the tool and the tool is inverted and placed at the ceiling-to-wall intersection such that the second extension arm engages the wall and the first extension arm engages the ceiling. Utilizing the measurement indicia on the second extension arm of the tool, a point is then marked on the wall corresponding to the measurement taken during the measuring step. The crown molding is then aligned with the marked point on the wall prior to installation at the ceiling-to-wall intersection.

According to another claimed method, during the positioning step, the first side edge of the sample section is placed in full and complete contact with the inner major surface of the first extension arm of the measurement tool and the second side edge of the sample section is placed in contact with the inner major surface of the second extension arm of the measurement tool.

According to yet another claimed method, the second extension arm of the measurement tool has at least one elongate minor edge surface marked with an edge scale corresponding to and extending from the measurement indicia on the inner major surface of the second extension arm.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
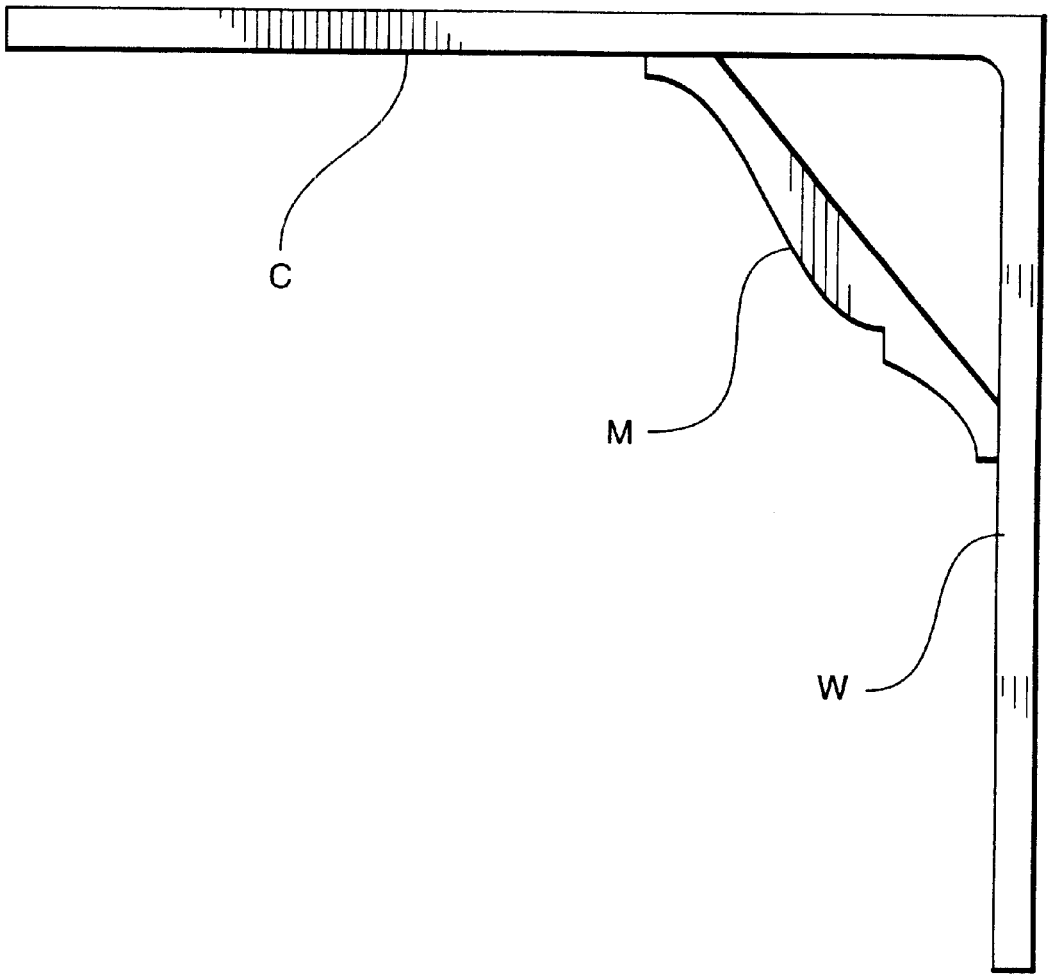
FIG. 1 is a vertical cross-section of a ceiling-to-wall intersection with crown molding installed incorrectly.
Figure 2:
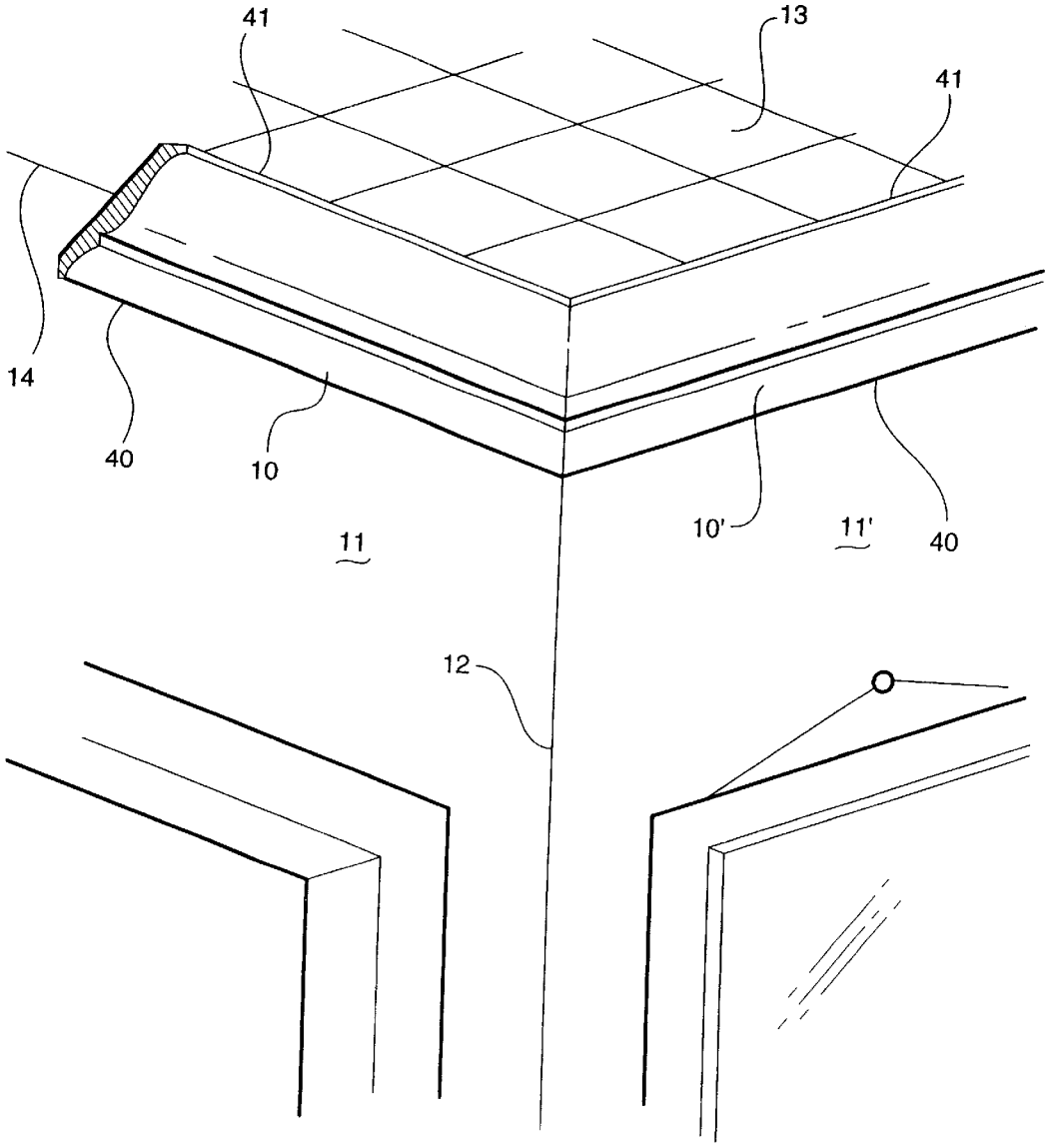
FIG. 2 is a fragmentary perspective view of a ceiling-to-wall intersection with crown molding installed.

Referring now specifically to the drawings, segments of crown molding installed at a ceiling-to-wall intersection are shown broadly at reference numerals 10 and 10' in FIG. 2. Two walls 11 and 11' intersect to form a corner 12. The walls 11 and 11' also intersect with a ceiling 13. Properly aligned crown molding segments 10 and 10' are installed at the ceiling-to-wall intersection 14.

Figure 3:
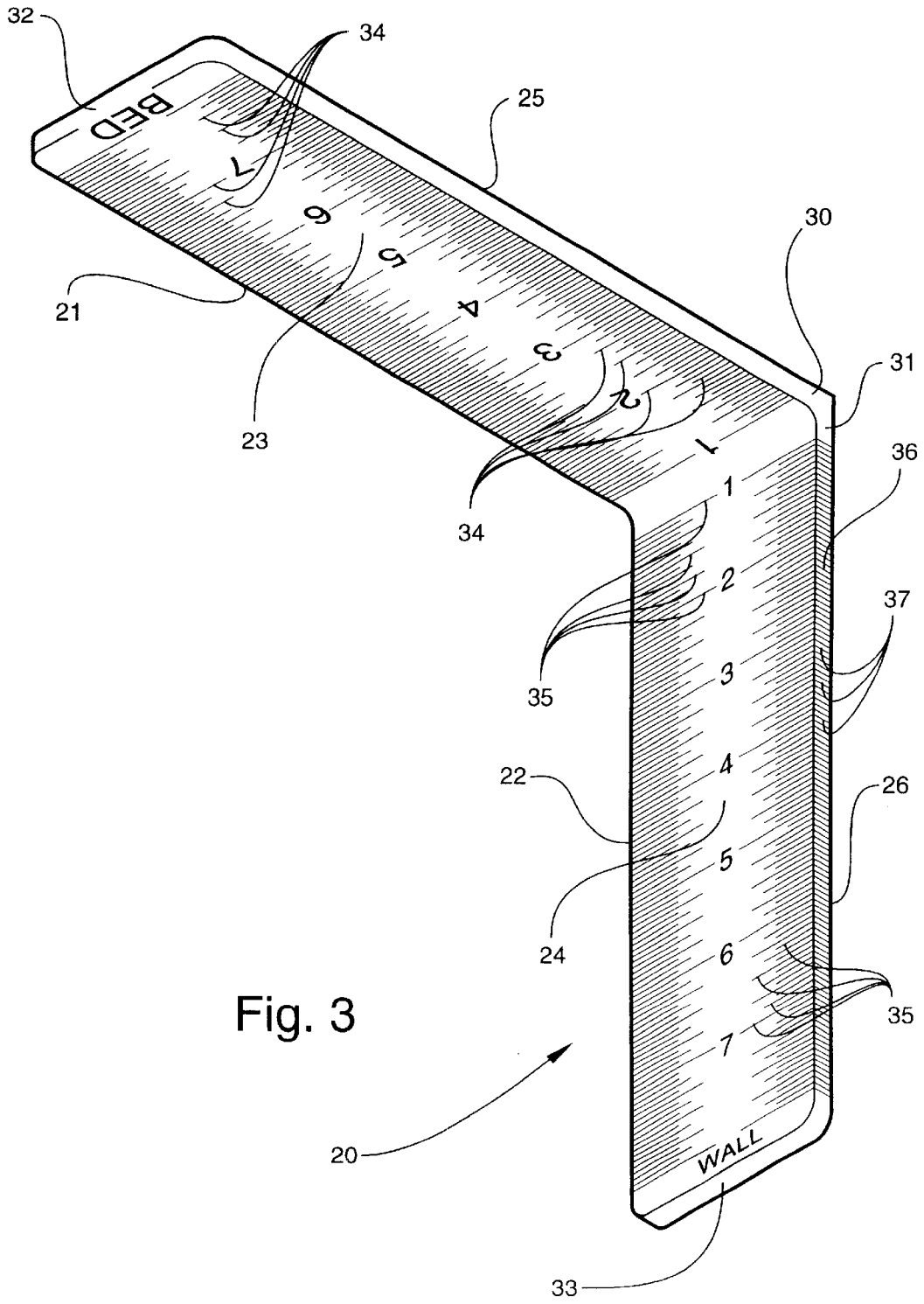
FIG. 3 is a perspective view of the apparatus according to one preferred embodiment of the invention.

Turning now to FIG. 3, the tool is shown broadly at reference numeral 20. The tool 20 is comprised of a first extension arm 21 and a second extension arm 22. The extension arms 21 and 22 have respective inner major surfaces 23 and 24, outer major surfaces 25 and 26, proximal ends 30 and 31, and distal ends 32 and 33. The extension arms 21 and 22 are connected together at their proximal ends 30 and 31 such that their respective inner major surfaces 23 and 24 face other at right angles. The respective inner major surfaces 23 and 24 of the extension arms 21 and 22 are marked with respective measurement indicia 34 and 35. Although the measurement indicia 34 and 35 may take many forms and use many scales (metric, English, etc.), in a preferred embodiment, the measurement indicia 34 and 35 are demarcations of inches with the smallest gradations measuring 1/16 inch each. Preferably, each extension arm 21 and 22 is formed of substantially rigid material and is approximately 8 inches long and 1 inch wide. In another preferred embodiment, the measurement indicia 35 marked on the inner major surface 24 of the second extension arm 22 extend onto at least one elongate minor edge surface 36 of the second extension arm 22 to provide a corresponding edge scale 37.

In a preferred embodiment of the tool 20, the extension arms 21 and 22 are of substantially equal thickness of approximately ¼ inch. In order to provide for correct crown molding measurement and placement according to the method of the invention described below, the measurement indicia 34 or 35 marked on one extension arm 21 or 22 are shifted relative to the measurement indicia 34 or 35 marked on the other extension arm 21 or 22 in an amount substantially equal to the ¼ inch thickness of one of the extension arms 21 or 22. In order to indicate which extension arm 21 or 22 is marked with the shifted measurement indicia 34 or 35, the first extension arm 21 is marked with the word "BED" and includes measurement indicia 34 that are shifted ¼ inch towards the distal end 32 of the first extension arm 21 relative to the orientation of the measurement indicia 35 marked on the second extension arm 22. In the same preferred embodiment, the second extension arm 22 is marked with the word "WALL." The particular chosen dimensions of and markings on the tool are immaterial as long as the measurement indicia on one of the extension arms is shifted relative to the measurement indicia on the other extension arm in order to counteract the effect of the thickness of one of the extension arms on the measurements taken and some indication of which extension arm is marked with the shifted measurement indicia is provided.

Figure 4:
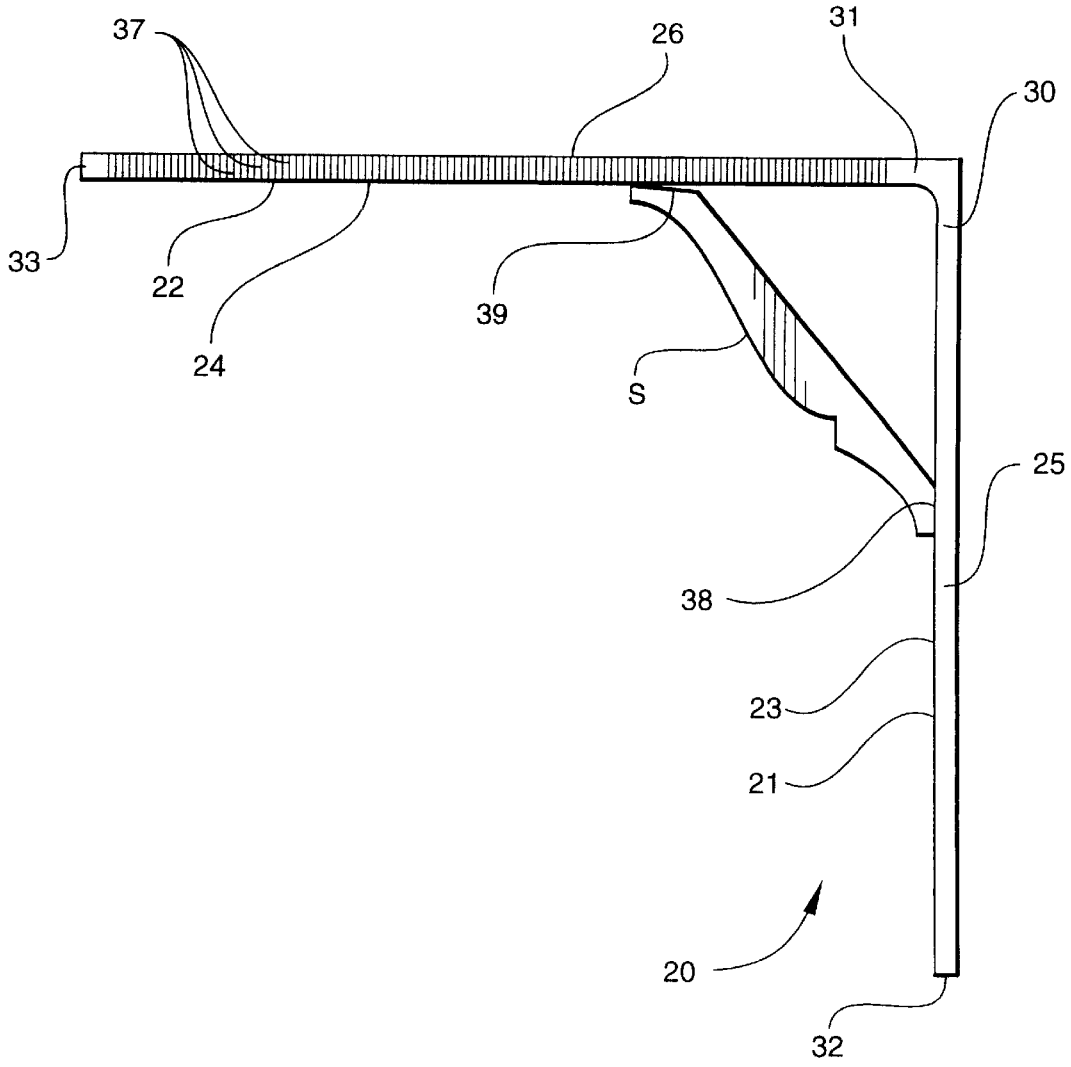
FIG. 4 is a side elevation of the apparatus according to one preferred embodiment of the invention, with a sample section of crown molding bedded therein.

The above-described tool 20 is utilized to practice a method of the present invention for facilitating accurate placement and installation of crown molding segments at ceiling-to-wall intersections. Looking again at FIG. 2, the crown molding segments 10 and 10' have respective wall-engaging portions 40 and ceiling-engaging portions 41. Turning now to FIG. 4, to begin the method, a relatively short sample section "S" of the crown molding segment 10 or 10' is positioned the tool 20. The sample section "S" has a first longitudinal side edge 38 representing the wall-engaging portion 40 of the crown molding segment 10 or 10' and an opposing second longitudinal side edge 39 representing the ceiling-engaging portion 41 of the crown molding segment 10 or 10'. The first side edge 38 of the sample section "S" is positioned to reside adjacent the inner major surface 23 of the first extension arm 21 of the tool 20 and the second side edge of the sample section "S" is positioned to reside adjacent the inner major surface 24 of the second extension arm 22 of the tool 20. To ensure proper measurement, in a preferred method, the first side edge 38 of the sample section "S" must be in full and complete contact with the inner major surface 23 of the first extension arm 21 of the tool 20 and the second side edge 39 of the sample section "S" must be in contact, though not necessarily full and complete contact, with the inner major surface 24 of the second extension arm 22 of the tool 20. With the sample section "S" in this position, the distance from the proximal end 30 of the first extension arm 21 of the tool 20 to the first side edge 38 of the sample section "S" is measured. The sample section "S" is then removed from the tool 20.

After removing the sample section "S" from the tool 20, the tool 20 is placed at the ceiling-to-wall intersection 14 such that the second extension arm 22 of the tool 20 engages a wall 11 or 11' and the first extension arm 21 of the tool 20 engages the ceiling 13. Utilizing the measurement indicia 35 and, in a preferred method, the edge scale 37 on the second extension arm 22 of the tool 20, several points (not shown) on the wall 11, 11' corresponding to the measurement taken earlier are marked at spaced intervals. Finally, the crown molding segment 10 or 10' is aligned with the marked points on the wall 11, 11' before permanently attaching the crown molding segment 10 or 10' at the ceiling-to-wall intersection 14.

The above-described preferred method provides for measurement and placement of crown molding at a ceiling-to-wall intersection without the need of holding the crown molding against the ceiling-to-wall intersection before the crown molding is to be installed. Of particular importance in the preferred method is the inversion of the tool between the measuring step and the marking step such that the error introduced by the thickness of one extension arm of the tool in the measuring step is counteracted by the shifted measurement indicia and corresponding edge scale on the extension arm of the tool that engages the wall during the marking step.

An apparatus and method for facilitating accurate placement and installation of crown molding is described above. Various details of the invention may be changed without departing from its scope. Furthermore, the foregoing description of the preferred embodiment of the invention and the best mode for practicing the invention are provided for the purpose of illustration only and not for the purpose of limitation, the invention being defined by the claims.

I claim:

1. A tool for facilitating accurate placement and installation of the crown molding at an intersection of a ceiling and wall, the crown molding having a wall-engaging portion and a ceiling-engaging portion, said tool comprising:

(a) first and second extension arms, each of said first and second extension arms having respective inner and outer major surfaces and respective proximal and distal ends;

(b) said first and second extension arms being connected together at their respective proximal ends such that their respective inner major surfaces face each other at right angles for receiving and orienting a sample section of the crown molding, said sample section having a first longitudinal side edge representing the wall-engaging portion of the crown molding for residing adjacent the first extension arm and an opposing second longitudinal side edge representing the ceiling-engaging portion of the crown molding for residing adjacent the second extension arm; and (c) measurement indicia marked on each of the inner major surfaces of said first and second extension arms for measuring the sample section to determine its position at the intersection of the ceiling and wall, wherein said measurement indicia on one of the inner major surfaces are shifted relative to the measurement indicia on the other of the interior surfaces in an amount substantially equal to the thickness of one of the extension arms.

2. A tool according to claim 1 further comprising an edge scale marked onto at least one elongate minor edge surface of at least one extension arm, said edge scale corresponding to and extending from the measurement indicia marked on the inner major surface of said at least one extension arm.

3. A tool according to claim 2, wherein the smallest gradations of said measurement indicia and said edge scale each measure 1/16 of an inch.

4. A tool according to claim 1, wherein said extension arms are of substantially equal thickness.

5. A tool according to claim 1, wherein said extension arms are formed of substantially rigid material.

6. A tool according to claim 1, wherein each of said extension arms is approximately 8 inches in length.

* * * * *